US008204431B2

(12) United States Patent
Shiraki et al.

(10) Patent No.: US 8,204,431 B2
(45) Date of Patent: Jun. 19, 2012

(54) COMPACT IMAGE FORMING APPARATUS WITH POST-PROCESSING

(75) Inventors: Takamasa Shiraki, Yokohama (JP); Takayuki Andoh, Kawasaki (JP); Kohji Hatayama, Ebina (JP); Yoshihide Ohta, Sagamihara (JP); Masato Ogawa, Sagamihara (JP); Tetsuya Fujioka, Yokohama (JP); Takuji Takahashi, Yokohama (JP); Yasunobu Youda, Sagamihara (JP); Kazushige Kawamura, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 904 days.

(21) Appl. No.: 12/232,290

(22) Filed: Sep. 15, 2008

(65) Prior Publication Data

US 2009/0074495 A1 Mar. 19, 2009

(30) Foreign Application Priority Data

Sep. 14, 2007 (JP) ..... 2007-239716
Jun. 17, 2008 (JP) ..... 2008-157842

(51) Int. Cl.
*G03G 15/00* (2006.01)

(52) U.S. Cl. ..... 399/410; 399/407; 399/408; 399/367

(58) Field of Classification Search ..... 399/410, 399/407, 408; 270/37
See application file for complete search history.

(56) References Cited

U.S. PATENT DOCUMENTS 6,353,727 B1 * 3/2002 Muraoka et al. ..... 399/410
6,690,901 B2 2/2004 Katsuyama et al.
6,898,395 B2 5/2005 Mui et al.
7,107,004 B2 * 9/2006 Saito ..... 399/405
7,410,156 B2 * 8/2008 Ikeda et al. ..... 270/37
2002/0150403 A1 10/2002 Katsuyama et al.
2006/0280530 A1 12/2006 Andoh
2007/0279888 A1 12/2007 Nanno et al.

FOREIGN PATENT DOCUMENTS

JP 05-197225 8/1993
JP 2595418 1/1997
JP 2000-086076 3/2000
JP 2002-207329 7/2002

(Continued)

OTHER PUBLICATIONS

Abstract of JP 05-204214 published Aug. 13, 1993.

(Continued)

*Primary Examiner* — Matthew G Marini
(74) *Attorney, Agent, or Firm* — Harness, Dickey & Pierce, P.L.C.

(57) ABSTRACT

In an image forming apparatus, when a first sheet discharger discharges a sheet bearing an image in a first direction from a proximal end to a distal end of the image forming apparatus, a post-processing device performs post-processing including at least one of stapling, punching, stamping, and sorting of the sheet discharged from the first sheet discharger. After a second sheet discharger discharges the processed sheet in a second direction opposite to the first direction in which the first sheet discharger discharges the sheet bearing the image, a sheet stacker stacks the sheet discharged from the second sheet discharger. A sheet conveyance path is provided between the first sheet discharger and the second sheet discharger. An opening is provided between the sheet stacker and an image reader so that the sheet discharged from the second sheet discharger can be retrieved from the sheet stacker in the second direction.

2 Claims, 8 Drawing Sheets

FOREIGN PATENT DOCUMENTS

| | | |
|---|---|---|
| JP | 3476637 | 9/2003 |
| JP | 2004-123332 | 4/2004 |
| JP | 3571986 | 7/2004 |
| JP | 2004-334040 | 11/2004 |
| JP | 2006-036500 | 2/2006 |
| JP | 3933730 | 3/2007 |
| JP | 2007-316142 | 12/2007 |

OTHER PUBLICATIONS

Abstract of JP 10-069137 published Mar. 10, 1998.
Abstract of JP 2001-072311 published Mar. 21, 2001.
Abstract of JP 10-177282 published Jun. 30, 1998.

* cited by examiner

COMPACT IMAGE FORMING APPARATUS WITH POST-PROCESSING

PRIORITY STATEMENT

The present patent application claims priority from Japanese Patent Application Nos. 2007-239716, filed on Sep. 14, 2007, and 2008-157842, filed on Jun. 17, 2008 in the Japan Patent Office, the entire contents of each of which are hereby incorporated herein by reference.

BACKGROUND OF THE INVENTION

1. Field of the Invention

Example embodiments generally relate to an image forming apparatus, for example, capable of accommodating a post-processing apparatus for performing post-processing of a sheet.

2. Description of the Related Art

Related-art image forming apparatuses, such as copiers, facsimile machines, printers, or multifunction devices having at least one of copying, printing, scanning, and facsimile functions, typically form an image on a recording medium (e.g., a sheet) based on image data.

Such image forming apparatuses include an output tray, typically attached to an outer surface of a body of the image forming apparatus, to which sheets bearing formed images are discharged. However, attaching the output tray to the outer surface of the body of the image forming apparatus, the image forming apparatus increases in width and occupies more space.

To keep the overall size of the image forming apparatus within manageable bounds, therefore, an internal-discharge-type image forming apparatus has been developed. In the internal-discharge-type image forming apparatus, a sheet stacker, serving as an output tray, is provided between a scanner and the body of the image forming apparatus. In other words, an upper surface of the body of the image forming apparatus functions as the sheet stacker, thereby making the image forming apparatus more compact.

In response to recent needs for post-processing of printed sheets, the above internal-discharge-type image forming apparatus has come to be provided with a post-processing device for performing post-processing, for example, stapling, punching, stamping, sorting, and the like.

In one example of a related-art image forming apparatus provided with such a post-processing device, after image formation, the post-processing device processes a sheet or a set of sheets and discharges the processed sheet or set of sheets to a sheet stacker. However, addition of the post-processing device substantially increases the height or width of the image forming apparatus.

To address this problem, in another example of a related-art image forming apparatus a post-processing device is mounted on a distal surface of the image forming apparatus. However, with such an arrangement, the post-processing device constricts a space between a scanner and a sheet stacker, thereby hindering retrieval of a processed sheet or sheets from the sheet stacker. On the other hand, providing a larger space between the scanner and the sheet stacker in order to facilitate such retrieval increases the height of the image forming apparatus.

Obviously, such increase in height or width of the image forming apparatus is undesirable, and accordingly, there is a need to provide an image forming apparatus that is compact even when provided with a post-processing device, and yet facilitates retrieval of a processed sheet or sheets from the sheet stacker.

SUMMARY

At least one embodiment may provide an image forming apparatus that includes an image recorder, a first sheet discharger, an image reader, a post-processing device, a second sheet discharger, a sheet stacker, a sheet conveyance path, and an opening. The image recorder forms an image on a sheet. The first sheet discharger discharges the sheet bearing the image in a first direction from a proximal end to a distal end of the image forming apparatus. The image reader is provided above the image recorder to form a gap therebetween. The post-processing device performs post-processing including at least one of stapling, punching, stamping, and sorting of the sheet discharged from the first sheet discharger. The second sheet discharger is provided between the first sheet discharger and the image reader, to discharge the sheet post-processed by the post-processing device in a second direction opposite to the first direction in which the first sheet discharger discharges the sheet bearing the image. The sheet stacker stacks the sheet discharged from the second sheet discharger. The sheet conveyance path is provided between the first sheet discharger and the second sheet discharger. The opening is provided between the sheet stacker and the image reader to enable the sheet discharged from the second sheet discharger to be retrieved from the sheet stacker in the second direction in which the sheet is discharged from the second sheet discharger. The post-processing device is disposed within the sheet conveyance path.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
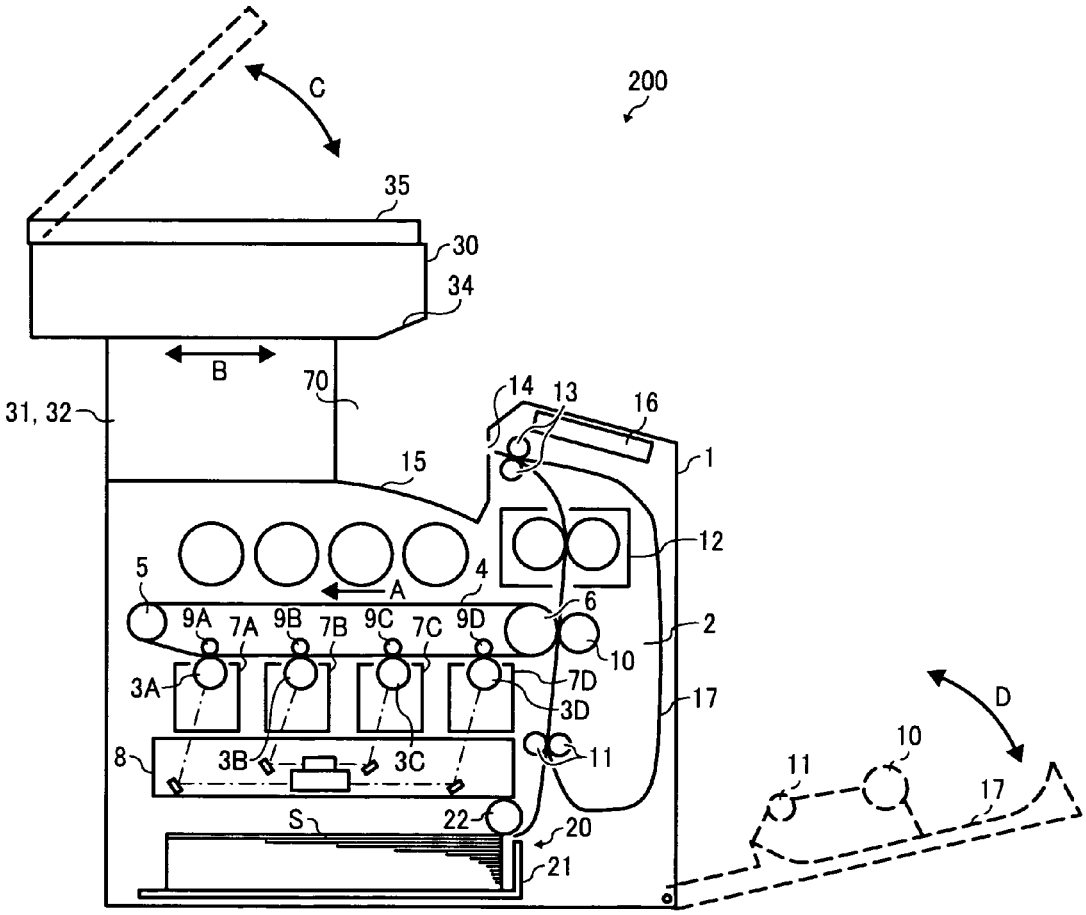
FIG. 1 is a schematic view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, in particular to FIG. 1, an image forming apparatus 200 according to an example embodiment of the present invention is described.

FIG. 1 is a schematic view of the image forming apparatus 200, which in this case is a tandem-type full color image forming apparatus. The image forming apparatus 200 includes a body 1, an image recorder 2, an optical scanning device 8, a feeding device 20, a registration roller pair 11, a fixing device 12, a discharge roller pair 13, an exit 14, a sheet stacker 15, a control panel 16, a reversal conveyance path 17, supports 31 and 32, an opening 70, and/or a scanner 30. The image recorder 2 includes photoconductors 3A, 3B, 3C, and 3D, an intermediate transfer belt 4, support rollers 5 and 6, a secondary transfer roller 10, image forming units 7A, 7B, 7C, and 7D, and/or transfer devices 9A, 9B, 9C, and 9D. The feeding device 20 includes a paper tray 21, and/or a feed roller 22. The scanner 30 has a sloped section 34 and/or a pressing plate 35.

The image forming apparatus 200 may be a copier, a facsimile machine, a printer, a multifunction printer having at least one of copying, printing, scanning, and facsimile functions, or the like. According to this non-limiting example embodiment, the image forming apparatus 200 functions as a tandem-type color copier for forming a color image on a recording medium (e.g., a sheet) using electrophotography. However, the image forming apparatus 200 is not limited to a color copier and thus may form a color and/or monochrome image in other configurations.

The image recorder 2 is provided in a center of the body 1 of the image forming apparatus 200. The feeding device 20 is provided below the image recorder 2, and feeds a sheet S on which the image recorder 2 forms an image. The scanner 30, serving as an image reader, is provided above the image recorder 2.

The photoconductors 3A, 3B, 3C, and 3D, serving as image carriers, have a drum-like shape and form toner images in different colors, respectively. According to this example embodiment, the photoconductors 3A, 3B, 3C, and 3D form yellow, cyan, magenta, and black toner images, respectively. The photoconductors 3A, 3B, 3C, and 3D are provided side by side at a predetermined distance opposite the endless intermediate transfer belt 4, which serves as an intermediate transfer member. The endless intermediate transfer belt 4 is looped over the support rollers 5 and 6 and moves in a direction A. Alternatively, the intermediate transfer member may be a drum. The secondary transfer roller 10 opposes the support roller 6 across the intermediate transfer belt 4.

The photoconductors 3A, 3B, 3C, and 3D are provided in the image forming units 7A, 7B, 7C, and 7D, respectively. The image forming units 7A, 7B, 7C, and 7D include chargers, development devices, cleaners, and the like, respectively. The chargers charge respective surfaces of the photoconductors 3A, 3B, 3C, and 3D. The development devices develop electrostatic latent images formed on the surfaces of the photoconductors 3A, 3B, 3C, and 3D, into visible toner images. The cleaners collect and remove residual toner remaining on the surfaces of the photoconductors 3A, 3B, 3C, and 3D after the toner images are transferred onto the intermediate transfer belt 4. The optical scanning device 8 is provided below the image forming units 7A, 7B, 7C, and 7D, and directs a laser beam onto the respective surfaces of the photoconductors 3A, 3B, 3C, and 3D to form electrostatic latent images on the photoconductors 3A, 3B, 3C, and 3D, respectively, based on image information. The feeding device 20 is provided below the optical scanning device 8.

When the image forming apparatus 200 starts image formation, the photoconductors 3A, 3B, 3C, and 3D rotate clockwise while the optical scanning device 8 emits a laser beam onto the respective charged surfaces of the photoconductors 3A, 3B, 3C, and 3D, respectively, thereby forming electrostatic latent images thereon. After development, the electrostatic latent images formed on the respective surfaces of the photoconductors 3A, 3B, 3C, and 3D are made visible as toner images. The transfer devices 9A, 9B, 9C, and 9D transfer the toner images onto the intermediate transfer belt 4, respectively.

Therefore, in the full color image formation, the image forming apparatus 200 forms the yellow, cyan, magenta, and black toner images on the photoconductors 3A, 3B, 3C, and 3D, and sequentially transfers the above toner images onto the intermediate transfer belt 4 in this order to form a color toner image on the intermediate transfer belt 4.

The paper tray 21, serving as a sheet storage, stores a sheet S, for example, a transfer sheet or a resin film. The feed roller 22 feeds the sheet S stored in the paper tray 21. An operator can supply the sheet S to the paper tray 21 by drawing the paper tray 21 out of the image forming apparatus 200 from a front of the image forming apparatus 200.

After being fed from the feeding device 20, the sheet S is conveyed toward the registration roller pair 11. When the registration roller pair 11 contacts a leading edge of the sheet S, the registration roller pair 11 stops rotating, thereby aligning the sheet. Thereafter, the registration roller pair 11 resumes rotating and conveys the sheet S toward the secondary transfer roller 10, serving as a secondary transfer member, at a time when the color toner image formed on the intermediate transfer belt 4 meets the leading edge of the sheet S.

After the secondary transfer member transfers an unfixed toner image onto the sheet S, the fixing device 12 fixes the toner image on the sheet S. Thereafter, the sheet S is discharged from the exit 14 to the sheet stacker 15 provided on an upper surface of the body 1 via the discharge roller pair 13 with an image-bearing side of the sheet S facing down. For example, in single-sided printing, the image forming apparatus 200 performs image formation on a sheet S and discharges the sheet S in order of ascending page number. In duplex printing, after single-sided fixation of the toner image, when a trailing edge of the sheet S is sandwiched by the discharge roller pair 13, the discharge roller pair 13 rotates in reverse to guide the sheet S to the reversal conveyance path 17. After an image is formed on a back side of the sheet S, the sheet S is discharged from the exit 14 to the sheet stacker 15 via the discharge roller pair 13 with the image-bearing side of an odd-numbered page facing down. To be specific, in duplex printing, after an even-numbered page of an original document is printed on single-sided of a sheet S, the reversal conveyance path 17 reverses the sheet S, and an odd-numbered page of the original document is then printed on another side of the sheet S.

Since the discharge roller pair 13 and the exit 14, together serving as a first sheet discharger, are provided on the front of the body 1, the sheet S is discharged to the sheet stacker 15 from front to rear of the image forming apparatus 200. The control panel 16, serving as an operating device, is provided on an upper surface of a housing of the discharge roller pair 13 and the exit 14, and controls operation of the scanner 30 and the image recorder 2.

The supports 31 and 32 are provided on both sides of the sheet stacker 15, and slidably move the scanner 30 in directions B while supporting the scanner 30. When the scanner 30 slides and moves from front to rear of the body 1, the opening 70 increases in size, thereby improving visibility and facilitating removal of the sheet S stacked on the sheet stacker 15. In addition, the sloped section 34 is provided in a lower front portion of the scanner 30, thereby increasing the size of the opening 70, so that the operator can clearly view and easily remove the sheet S from the sheet stacker 15 of the image forming apparatus 200. Further, since the supports 31 and 32 are provided on both sides of the sheet stacker 15 in a direction in which the sheet S is discharged from the exit 14, both a front and a rear of the sheet stacker 15 are open.

An exposure glass surface, not shown, is provided on an upper surface of the scanner 30, and reads image information of an original document placed thereon. The pressing plate 35 is provided over the exposure glass surface, and rotatable from proximal end to distal end of the body 1 in directions C. Alternatively, instead of the pressing plate 35, the image forming apparatus 200 may include an automatic document feeder. In such a case, when the operator puts an original document on an original document tray and presses a Start key, the original document is conveyed to the scanner 30 from a first page. After the scanner 30 reads an image of the original document, the original document is discharged to an original document discharge tray.

In addition, a front cover of the body 1 rotates in directions D to expose the reversal conveyance path 17, so that the operator can remove a paper jam in the reversal conveyance path 17 in front of the image forming apparatus 200. Moreover, since the front cover of the body 1 is openable, the operator can take the intermediate transfer belt 4 out of the image forming apparatus 200 and perform maintenance of the image forming apparatus 200.

Figure 2:
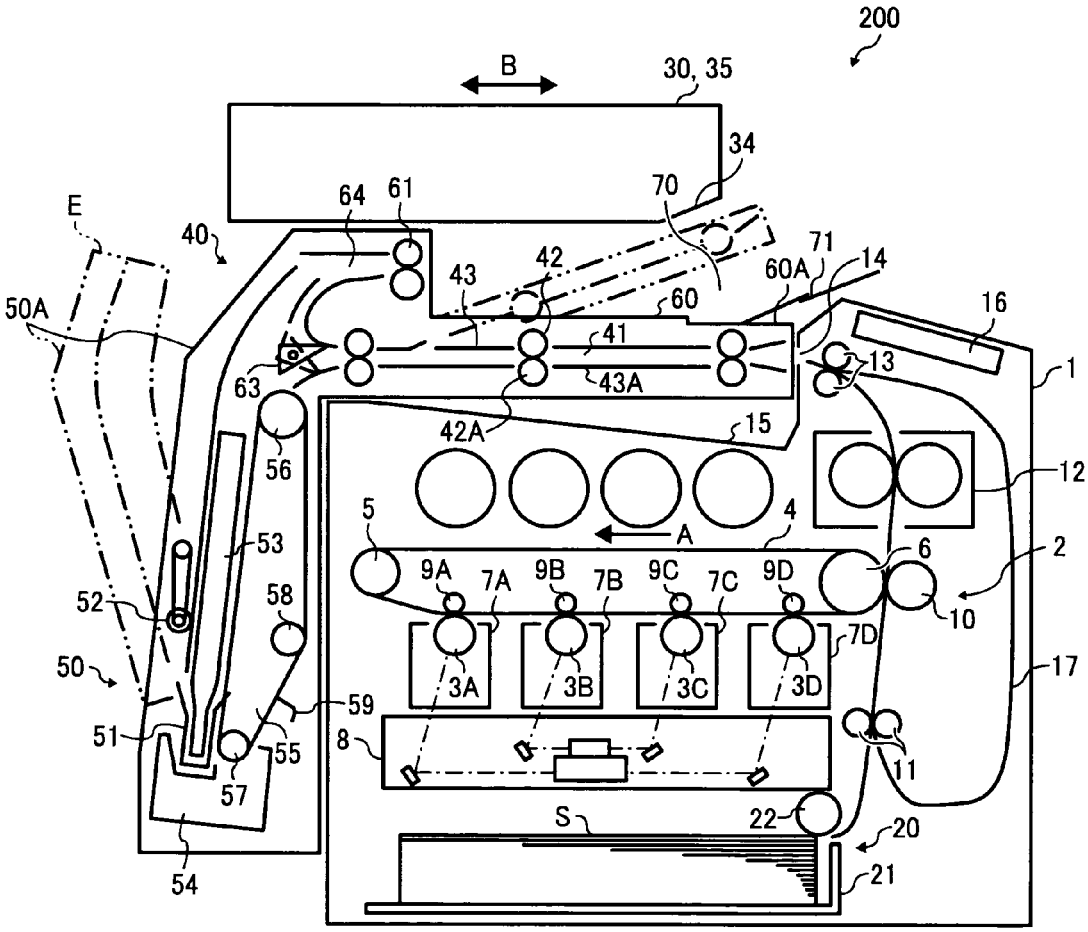
FIG. 2 is a schematic view (according to an example embodiment) of the image forming apparatus shown in FIG. 1 provided with a post-processing unit according to an example embodiment.

FIG. 2 is a schematic view of the image forming apparatus 200 provided with a post-processing unit 40 according to the example embodiment. The post-processing unit 40 includes a post-processing device 50, a transit conveyer 41, a sheet stacker 60, a second discharger 61, a switching nail 63, a path 64, and/or an extensible tray 71. The post-processing device 50 includes an edge fence 51, a hitting roller 52, a jogger fence 53, a stapler 54, a discharge belt 55, rollers 56, 57, and 58, a hook 59, and/or a rear plate 50A. The transit conveyer 41 includes upper and lower conveyance rollers 42 and 42A, and/or upper and lower guide plates 43 and 43A. The sheet stacker 60 includes a concave portion 60A.

The post-processing unit 40 has a substantially L-shaped form rotated clockwise 90 degrees. The transit conveyer 41, serving as a non-reverse path, is provided in a horizontal portion of the post-processing unit 40, and guides the sheet S discharged from the exit 14 toward a vertical portion of the post-processing unit 40 in which the post-processing device 50 is provided. The conveyance rollers 42 and 42A are provided at an appropriate interval.

When the sheet S is conveyed to the post-processing device 50, the hitting roller 52 hits a leading edge of the sheet S against the edge fence 51. When the jogger fence 53 aligns a lateral direction of the sheet S, the stapler 54 staples a set of the aligned sheets S. Instead of the stapler 54, a punch may be used. Alternatively, the post-processing device 50 may include both the stapler 54 and the punch provided side by side, so that the post-processing device 50 can perform both stapling and punching. The endless discharge belt 55 is looped over the rollers 56, 57, and 58, and conveys the stapled or punched set of sheets S toward the sheet stacker 60. The hook 59 is attached to a surface of the discharge belt 55, and pushes the set of the sheets S upwards. Therefore, the hook 59 rotates according to rotation of the discharge belt 55 to catch an end of the set of the sheets S, thereby guiding the set of the sheets S toward the second discharger 61.

The sheet stacker 60 is provided above the transit conveyer 41 of the post-processing unit 40. The second discharger 61 is provided above a corner of the horizontal portion of the post-processing unit 40 and the vertical portion thereof, and discharges the set of the sheets S onto the sheet stacker 60. The switching nail 63, serving as a switching member, is provided therebelow, and switches the conveyance direction of the sheet S sent from the transit conveyer 41 between a direction in which the sheet S is conveyed toward the post-processing device 50 and a direction in which the sheet S is conveyed toward the second discharger 61 without being conveyed to the post-processing device 50 and is discharged to the exterior of the image forming apparatus 200.

Specifically, in order to perform post-processing of stapling the sheets S using the stapler 54, the image forming apparatus 200 to which the post-processing unit 40 is connected conveys the sheet S from the body 1 to the post-processing device 50 via the transit conveyer 41. That is, when the switching nail 63 closes a path to the second discharger 61, as indicated by the switching nail 63 in a solid line in FIG. 2, to open a path to the post-processing device 50, the sheet S is conveyed to the post-processing device 50. Rotation of the hitting roller 52 causes, the leading edge of the conveyed sheet S to hit against the edge fence 51, thereby aligning the edge of the sheet S, while the jogger fence 53 aligns a lateral direction of the sheet S. Moreover, since the post-processing device 50 is provided in the vertical portion of the post-processing unit 40, the edge of the sheet S can be efficiently aligned by gravity.

Every sheet S is aligned when conveyed to the post-processing device 50. When the aligned sheets S reach a predetermined number, the stapler 54 staples a set of the aligned sheets S. The stapled set of sheets S is caught and stopped by the hook 59 attached to the discharge belt 55, conveyed upwards, and discharged to the sheet stacker 60 via the path 64. The operator can easily remove the discharged set of sheets S from the opening 70 provided between the first discharger 61 and the scanner 30 in front of the image forming apparatus 200. When the sheet S is long, the leading edge of the sheet S may reach the control panel 16. In order to improve the operator's visibility of the control panel 61, the control panel 16 inclines downwardly from upstream to downstream in a direction in which the sheet S is discharged from the second discharger 61. Therefore, when the discharged sheet S reaches the control panel 61, the sheet S may drop down to the front of the image forming apparatus 200.

Therefore, in the case of using the long sheet S, the foldable extensible tray 71 is provided in the post-processing unit 40. When the extensible tray 71 is extended, an edge thereof does not interrupt visibility of the control panel 16, while leaving a sufficient space between the extensible tray 71 and a front end surface of the scanner 30 for the operator to remove the sheet S. When the extensible tray 71 is folded, the extensible tray 71 overlaps an upper surface of the sheet stacker 60. In order to prevent the leading edge of the discharged sheet S from hitting against the stored extensible tray 71, the concave portion 60A is provided in the sheet stacker 60, and stores the extensible tray 71 in the sheet stacker 60.

Therefore, since the image forming apparatus 200 provided with the post-processing unit 40 discharges both the processed sheet S and non-processed sheet S to the sheet stacker 60 provided inside the image forming apparatus 200, the sheet stacker 60 does not protrude from the front or the rear of the image forming apparatus 200. In addition, the post-processing unit 40 discharges the sheet S to the sheet stacker 60 in a direction opposite to a direction in which the sheet S is discharged to the sheet stacker 15 when the image forming apparatus 200 is not provided with the post-processing unit 40, thereby preventing the image forming apparatus 200 from increasing in height due to provision of the second discharger 61.

In other words, when the sheet S is discharged to the sheet stacker 60 in a direction equal to the direction in which the sheet S is discharged to the sheet stacker 15, the second discharger 61 needs to be provided above or below the discharge roller pair 13 and the exit 14, causing an increase in height of the image forming apparatus 200. However, according to this example embodiment, since the sheet S is discharged to the sheet stacker 60 in the direction opposite to the direction in which the sheet S is discharged to the sheet stacker 15, the second discharger 61 merely partly overlaps the first discharger, that is, the discharge roller pair 13 and the exit 14, in a vertical direction, thereby preventing an increase in height of the image forming apparatus 200.

Moreover, the upper conveyance roller 42 and the upper guide plate 43 of the transit conveyer 41 rotate upwards and separate from the lower conveyance roller 42A and the lower guide plate 43A, respectively fixed in a predetermined position, as indicated by dashed-dotted lines in FIG. 2. Therefore, when a paper jam occurs in the transit conveyer 41 of the post-processing unit 40, the upper conveyance roller 42 and the upper guide plate 43 rotate upwards to expose a path of the transit conveyer 41, thus facilitating removal of the paper jam from the opening 70 in front of the image forming apparatus 200. In addition, an inclined surface of the sloped section 34 of the scanner 30 enables the upper guide plate 43 to open at a larger angle than it would otherwise were this sloped section 34 not provided, thus further facilitating removal of the paper jam.

When a paper jam occurs in the post-processing device 50, or when the post-processing device 50 needs maintenance, for example, replacement of staples of the stapler 54, or the like, the rear plate 50A rotates distally, as indicated by dashed-dotted lines in FIG. 2, to expose a path inside the post-processing device 50, thus facilitating removal of a paper jam or maintenance of the post-processing device 50. In addition, when the rear plate 50A rotates, a top E of the rear plate 50A does not contact a bottom surface of the scanner 30. For example, when the rear plate 50A is closed and a perpendicular line drawn from the top E, the axis of rotation of the rear plate 50A is provided to the right in FIG. 2 of the perpendicular line. Therefore, according to the rotation of the rear plate 50A, the top E does not contact the bottom surface of the scanner 30. Further, since the scanner 30 is movable in the directions B from front to rear of the image forming apparatus 200, even when the scanner 30 remains at a rearwardmost position, the rotating rear plate 50A does not contact the scanner 30.

Figure 3:
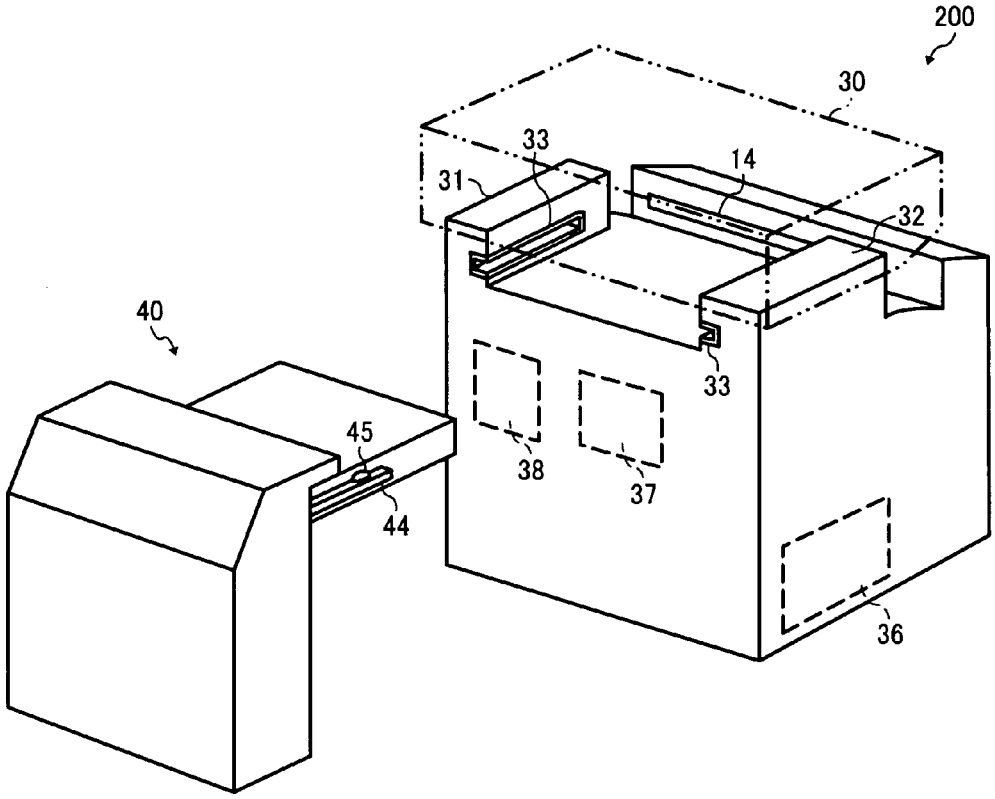
FIG. 3 is a schematic perspective view (according to an example embodiment) of the image forming apparatus shown in FIG. 2.

FIG. 3 is a schematic perspective view of the image forming apparatus 200 shown in FIG. 2 according to this example embodiment. The image forming apparatus 200 further includes a metal rail 33, an image processing board 38, a control board 37, and/or a power source unit 36. The post-processing unit 40 further includes a rail 44, and/or a stopper 45.

The post-processing unit 40 is mounted on a rear of the body 1 of the image forming apparatus 200. Specifically, the horizontal portion of the post-processing unit 40 is inserted into a gap between the scanner 30 and the sheet stacker 15 from the rear of the body 1. When the rails 44, serving as an engagement member, of the post-processing unit 40 are inserted into the U-shaped metal rails 33 provided on opposing surfaces of the supports 31 and 32, an end of the horizontal portion of the post-processing unit 40 is set in a proper position of the image forming apparatus 200, being connected to the exit 14 of the image forming apparatus 200. The stopper 45 is provided in an appropriate position of the rail 44. When the post-processing unit 40 is set in the proper position, the stopper 45 protrudes from the rail 44 to engage a hole. Therefore, the post-processing unit 40 is properly fixed to the body 1 of the image forming apparatus 200. In order to remove the post-processing unit 40 therefrom, the operator can pull out the post-processing unit 40 rearwards by depressing the stopper 45 with an operation mechanism. In addition, since the post-processing device 50 is heavier than the transit conveyer 41, the post-processing unit 40 tends to incline rearwards when the post-processing unit 40 is mounted on the image forming apparatus 200 and removed therefrom. However, the metal rail 33 prevents the post-processing unit 40 from inclining rearwards, so that the post-processing unit 40 can be stably mounted on the image forming apparatus 200 and removed therefrom.

The image processing board 38 for controlling image processing and the control board 37 for controlling a motor, a sensor, and the like are provided on an inner rear surface of the body 1 of the image forming apparatus 200. The power source unit 36 is provided on an inner side surface of the body 1.

As illustrated in FIG. 3, the post-processing device 50 opposes the rear of the body 1 of the image forming apparatus 200. A connection member is provided on a surface of the post-processing device 50 opposite the body 1, and an engagement member for engaging the connection member is provided on the control board 37. Therefore, when the post-processing unit 40 is mechanically connected the image forming apparatus 200, the post-processing unit 40 can be easily electrically connected to the body 1 of the image forming apparatus 200.

Since the power source unit 36 does not oppose the post-processing unit 40, the post-processing unit 40 does not prevent heat generated by the power source unit 36 from escaping therefrom, thereby reducing accumulation of heat inside the body 1 of the image forming apparatus 200.

The configuration of the image forming apparatus 200 is not limited to that described above, and thus, for example, as illustrated in FIG. 3, the post-processing unit 40 may be detachably attachable to the body 1 of the image forming apparatus 200. Alternatively, however, the post-processing unit 40 may be integrated into the body 1 of the image forming apparatus 200.

In addition, as illustrated in FIG. 2, the upper surface of the housing of the discharge roller pair 13 and the exit 14, on which the control panel 16 is provided, inclines downwards from the rear of the image forming apparatus 200 toward the front thereof. Alternatively, however, the upper surface of the housing of the discharge roller pair 13 and the exit 14 may be horizontal.

Further, although the scanner 30 is movable in the directions B, as illustrated in FIG. 2, alternatively, the scanner 30 may be fixed to the image forming apparatus 200.

Figure 4:
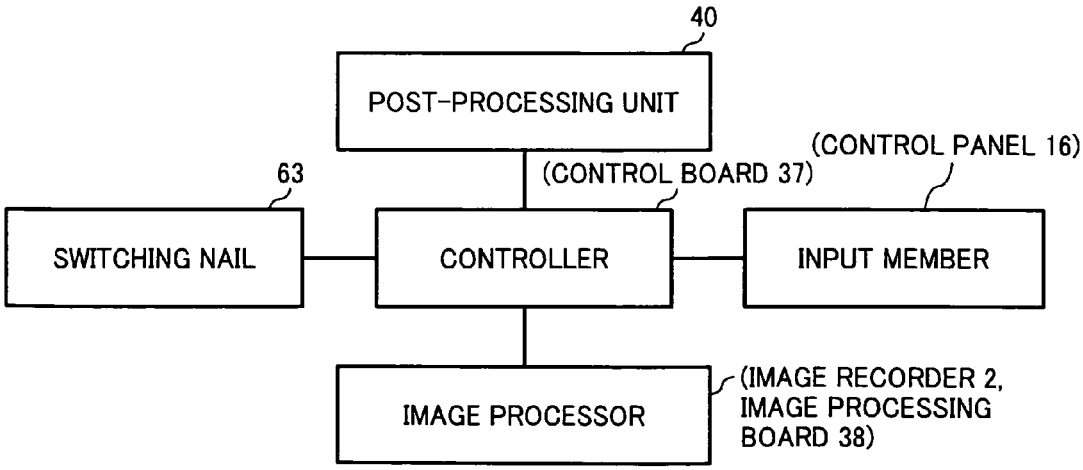
FIG. 4 is a block diagram (according to an example embodiment) of a configuration of the image forming apparatus shown in FIG. 3.
Figure 5A:
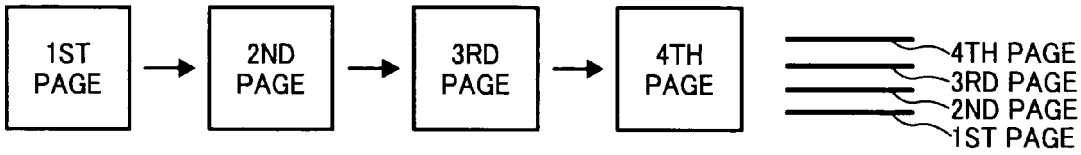
FIG. 5A is a schematic diagram (according to an example embodiment) illustrating an order of single-sided printing and a state of printed sheets when the image forming apparatus is not provided with the post-processing unit.
Figure 5B:
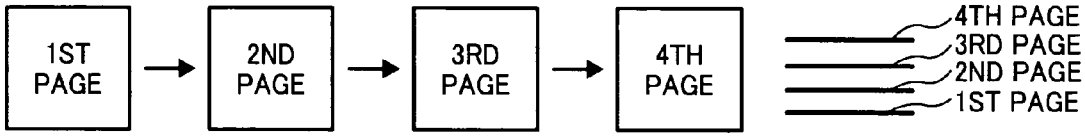
FIG. 5B is a schematic diagram (according to an example embodiment) illustrating an order of single-sided printing and a state of printed sheets when the image forming apparatus is provided with the post-processing unit.
Figure 5C:
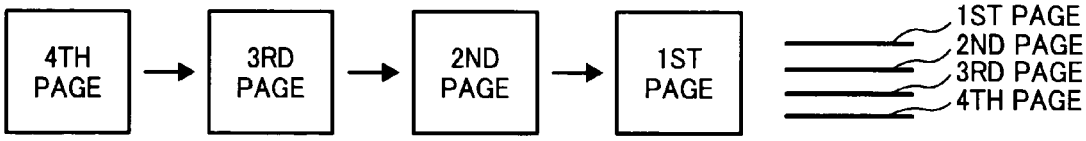
FIG. 5C is a schematic diagram (according to an example embodiment) illustrating an order of single-sided printing and a state of printed sheets when the image forming apparatus is provided with the post-processing unit.
Figure 5D:
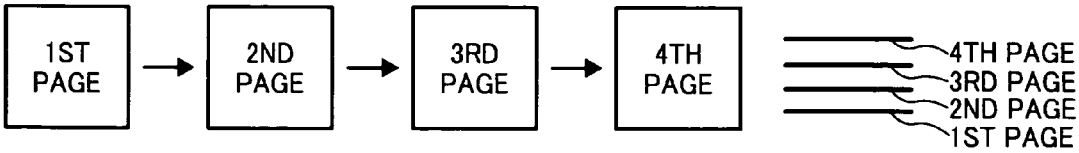
FIG. 5D is a schematic diagram (according to an example embodiment) illustrating an order of single-sided printing and a state of printed sheets when the image forming apparatus is provided with the post-processing unit.
Figure 6A:
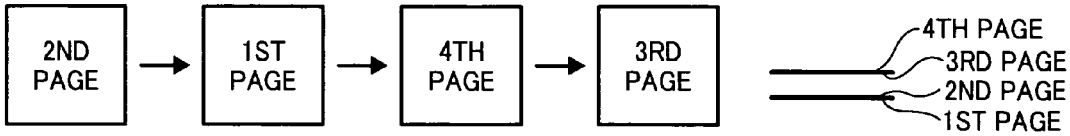
FIG. 6A is a schematic diagram (according to an example embodiment) illustrating an order of duplex printing and a state of printed sheets when the image forming apparatus is not provided with the post-processing unit.
Figure 6B:
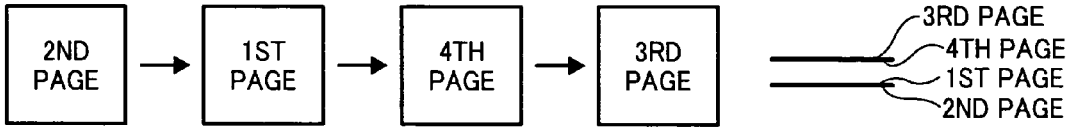
FIG. 6B is a schematic diagram (according to an example embodiment) illustrating an order of duplex printing and a state of printed sheets when the image forming apparatus is provided with the post-processing unit.
Figure 6C:
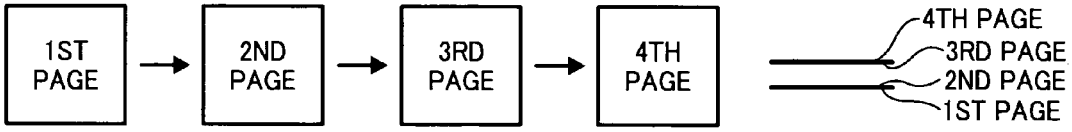
FIG. 6C is a schematic diagram (according to an example embodiment) illustrating an order of duplex printing and a state of printed sheets when the image forming apparatus is provided with the post-processing unit.
Figure 6D:
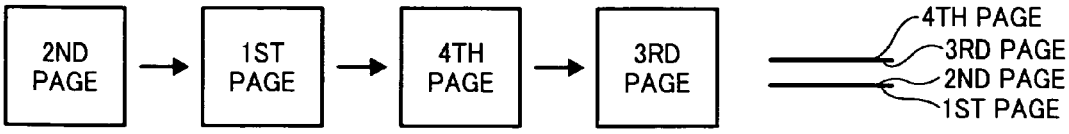
FIG. 6D is a schematic diagram (according to an example embodiment) illustrating an order of duplex printing and a state of printed sheets when the image forming apparatus is provided with the post-processing unit.

Referring to FIGS. 2, 4, 5A, 5B, 5C, 5D, 6A, 6B, 6C, and 6D, a description is now given of image formation and discharge control according to whether or not the image forming apparatus 200 performs post-processing. FIG. 4 is a schematic diagram of a configuration of the image forming apparatus 200. FIG. 5A illustrates an order of single-sided printing and a state of discharged sheets S stacked on the sheet stacker 60 when the post-processing unit 40 is not mounted on the image forming apparatus 200. FIGS. 5B to 5D illustrate an order of single-sided printing and a state of discharged sheets S when the post-processing unit 40 is mounted on the image forming apparatus 200. FIG. 6A illustrates an order of duplex printing and a state of discharged sheets S stacked on the sheet stacker 60 when the post-processing unit 40 is not mounted on the image forming apparatus 200. FIGS. 6B to 6D illustrate an order of duplex printing and states of the sheets S when the post-processing unit 40 is mounted on the image forming apparatus 200.

In a case of single-sided printing when the post-processing unit 40 is not mounted on the image forming apparatus 200, as illustrated in FIG. 1, a single-sided printed sheet S is discharged to the sheet stacker 15 with an image-bearing side thereof facing up and sequentially stacked thereon from the first page, as illustrated in FIG. 5A.

When the post-processing unit 40 mounted on the image forming apparatus 200 as depicted in FIG. 2 does not perform post-processing of a single-sided printed sheet S, the switching nail 63 depicted in FIG. 2 moves to a position indicated by a dotted line in FIG. 2 and closes a path connected to the post-processing device 50 to open the path 64, so as to convey the printed sheet S to the second discharger 61. Since the conveyed sheet S is reversed by passing though the path 64, serving as a reverse path, the sheet S is stacked on the sheet stacker 60 with an image-bearing side thereof facing up. Therefore, when the image forming apparatus 200 performs printing of sequential pages in an order of image formation performed by the image forming apparatus 200 on which the post-processing unit 40 is not mounted, as illustrated in FIG. SA, the pages get out of order, as illustrated in FIG. 5B.

Therefore, when the image forming apparatus 200 discharges the sheet S from the second discharger 61 without passing the sheet S through the post-processing device 50, a controller depicted in FIG. 4, that is, the control board 37 depicted in FIG. 3, orders the start of image formation from the last page, as illustrated in FIG. 5C. To be specific, upon receipt of an instruction to perform single-sided printing without post-processing from an input member depicted in FIG. 4, for example, the control panel 16 depicted in FIG. 3, the controller determines whether or not the post-processing unit 40 is mounted on the body 1. When the controller determines that the post-processing unit 40 is mounted thereon, the controller commands the switching nail 63 to switch to the position, as indicated by the dotted line in FIG. 2, and commands an image processor depicted in FIG. 4, for example, the image recorder 2 depicted in FIG. 2 and the image processing board 38 depicted in FIG. 3, to perform printing from the last page. Therefore, after the sheet S passes through the image recorder 2 and the transit conveyer 41 depicted in FIG. 2, the switching nail 63 sequentially guides the sheets S to the path 64 from the last page to the first page. After being reversed, the sheet S is discharged from the second discharger 61 to the sheet stacker 60.

Accordingly, the sheet S including the last page is stacked on the sheet stacker 60 with an image-bearing side thereof facing up. As a result, the first page is arranged uppermost with an image-bearing side facing up, as illustrated in FIG. 5C, thereby preventing the pages from getting out of order.

In a case of duplex printing when the post-processing unit 40 is not mounted on the image forming apparatus 200, as illustrated in FIG. 1, after an even-numbered page of an original document is printed on single-sided of a sheet S, the reversal conveyance path 17 reverses the sheet S, and an odd-numbered page of the original document is then printed on another side of the sheet S, so that the sheet S is discharged to the sheet stacker 15 with the image-bearing side of the odd-numbered page facing down, as illustrated in FIG. 6A.

When the post-processing unit 40 mounted on the image forming apparatus 200 does not perform post-processing of the duplex printed sheet, like the above case of single-sided printing without post-processing, after passing through the exit 14, the sheet S is reversed while conveyed through the path 64 and stacked on the sheet stacker 60. Therefore, when the image forming apparatus 200 performs printing of sequential pages in an order of image formation performed by the image forming apparatus 200 on which the post-processing unit 40 is not mounted, as illustrated in FIG. 6A, the pages get out of order, as illustrated in FIG. 6B.

Therefore, when the sheet S is discharged from the second discharger 61 without passing through the post-processing device 50, the controller orders the start of image formation from the first page, as illustrated in FIG. 6C.

To be specific, when the controller receives an instruction to perform duplex printing without post-processing from the input member, the controller determines whether or not the post-processing unit 40 is connected to the body 1. When the controller determines that the post-processing unit 40 is so connected, the controller commands the switching nail 63 to move to the position indicated by the dotted line in FIG. 2 and commands the image processor to perform printing from the first page. Therefore, after passing through the image recorder 2, the reversal conveyance path 17, the image recorder 2, and the transit conveyer 41 depicted in FIG. 2, the sheet S is guided to the path 64 by the switching nail 63 from the first page to the last page, reversed while conveyed on the path 64, and discharged from the second discharger 61 to the sheet stacker 60.

Accordingly, as illustrated in FIG. 6C, the sheet S including the first page is stacked on the sheet stacker 60 with an image-bearing side thereof facing down. As a result, the last page is arranged uppermost with an image-bearing side thereof facing up, thereby preventing the pages from getting out of order.

In a case of performing post-processing of a single-sided printed sheet S, the switching nail 63 switches to the position indicated by the solid line in FIG. 2 and closes the path 64 to open the path to the post-processing device 50, so that the sheet S is conveyed to the post-processing device 50. After a predetermined post-processing, for example, punching of each sheet S or stapling of a predetermined set of sheets S, the sheet S is switched back, passes through the path 64, and is discharged to the sheet stacker 60 with an image-bearing side thereof facing down, as when the printed sheet S is discharged from the exit 14. Therefore, even when the image forming apparatus 200 performs printing of sequential pages in the order of image formation performed by the image forming apparatus 200 on which the post-processing unit 40 is not mounted, as illustrated in FIG. 5A, the pages do not get out of order, as illustrated in FIG. 5D.

When the controller receives an instruction to perform post-processing of the single-sided printed sheet S from the input member, the controller determines whether or not the post-processing unit 40 is connected to the body 1 of the image forming apparatus 200. When the controller determines that the post-processing unit 40 is so connected, the controller commands the switching nail 63 to switch to the position, as indicated by the solid line in FIG. 2, and commands the image processor to perform printing from the first page. Therefore, the image recorder 2 prints a front side, that is, a first page, of the sheet S, and after the sheet S passes through the transit conveyer 41, the switching nail 63 guides the sheet S to the post-processing device 50. After post-processing, the processed sheet S is switched back and passes through the path 64, and is discharged from the second discharger 61 to the sheet stacker 60.

Accordingly, the sheet S of the first page is arranged lowermost on the sheet stacker 60 with an image-bearing side thereof facing down, thereby preventing the pages from getting out of order.

In a case of performing post-processing of a duplex printed sheet S, like the case of post-processing of the single-sided printed sheet S, the duplex printed sheet S is discharged to the sheet stacker 60 with the front and back sides thereof facing in a direction identical to a direction in which the front and back sides of the single-sided printed sheet S face when the processed sheet S is stacked on the sheet stacker 60. Therefore, when the image forming apparatus 200 performs printing of sequential pages on both sides of the sheet S in the order of image formation performed by the image forming apparatus 200 on which the post-processing unit 40 is not mounted, as illustrated in FIG. 6A, the pages do not get out of order, as illustrated in FIG. 6D.

In order to discharge the duplex printed sheet S (or a set of duplex printed sheets S) from the second discharger 61 after post-processing, the controller commands the image forming apparatus 200 to start image formation from an even-numbered page, as illustrated in FIG. 6D.

To be specific, when the controller receives an instruction to perform post-processing of a duplex printed sheet S from the input member, the controller determines whether or not the post-processing unit 40 is mounted on the body 1 of the image forming apparatus 200. When the controller determines that the post-processing unit 40 is mounted thereon, the controller commands the switching nail 63 to move to the position indicated by the solid line in FIG. 2 and commands the image processor to perform printing from a second page. Therefore, after the image recorder 2 performs image formation of the second page, the sheet S passes through the reversal conveyance path 17. Then, after the image recorder 2 performs image formation of a first page, the sheet S is conveyed through the transit conveyer 41 and guided to the post-processing device 50 by the switching nail 63. After post-processing, the sheet S is switched back, passes through the path 64, and is discharged from the second discharger 61 to the sheet stacker 60.

Therefore, the sheet S is stacked on the sheet stacker 60 with an image-bearing side of the first page facing down, so that the last page is arranged uppermost with an image-bearing side thereof facing up, as illustrated in FIG. 6D, thereby preventing the pages from getting out of order.

According to the example embodiment, only in single-sided printing without post-processing, as illustrated in FIG. 5C, is the sheet S discharged to the sheet stacker 60 face up. Alternatively, as in other cases, the sheet S can be discharged face down.

For example, when the sheet S passes through the transit conveyer 41 and is conveyed to the post-processing device 50, the sheet S is merely switched back without post-processing, so that the sheet S is discharged to the sheet stacker 60 via the second discharger 61 with the image-bearing side thereof facing down.

In this case, when the controller receives an instruction to perform single-sided printing without post-processing from the input member, the controller determines whether or not the post-processing unit 40 is connected to the body 1 of the image forming apparatus 200. When the controller determines that the post-processing unit 40 is so connected, the controller controls the switching nail 63 to switch to the position indicated by the solid line in FIG. 2 and commands the image processor to perform printing in the same order as the order of single-sided printing performed by the image forming apparatus 200 on which the post-processing unit 40 is not mounted, that is, printing from a first page, as illustrated in FIG. 5A. Therefore, after the sheet S passes through the image recorder 2 and the transit conveyer 41, the switching nail 63 guides the sheet S to the post-processing device 50 from the first page to the last page. After being switched back, the sheet S is discharged from the second discharger 61 to the sheet stacker 60.

According to the above-described example embodiment, only when the post-processing unit 40 mounted on the image forming apparatus 200 does not perform post-processing of the single-sided printed sheet S and the duplex printed sheet S, as illustrated in FIGS. 5C and 6C, is the order of printing different from the order of printing when the post-processing unit 40 is not mounted on the image forming apparatus 200. Alternatively, like the case of performing post-processing of the single-sided printed sheet S and the duplex printed sheet S, the post-processing device 50 may discharge the sheet S face down in the same order as the order of printing when the post-processing unit 40 is not mounted on the image forming apparatus 200.

In this case, when the controller receives an instruction to perform single-sided printing without post-processing from the input member, the controller determines whether or not the post-processing unit 40 is connected to the body 1 of the image forming apparatus 200. When the controller determines that the post-processing unit 40 is so connected, the controller causes the switching nail 63 to switch to the position indicated by the dotted line in FIG. 2 and commands the image processor to perform printing in the order equal to the order of printing performed by the image forming apparatus 200 on which the post-processing unit 40 is not mounted, as illustrated in FIG. 5A and FIG. 6A, that is, from the first page in single-sided printing, or from the second page in duplex printing.

Therefore, after the image forming apparatus 200 on which the post-processing unit 40 is mounted performs image formation as the image forming apparatus 200 on which the post-processing unit 40 is not mounted does, the sheet S passes through the transit conveyer 41 with the first page facing down and is guided to the post-processing device 50 by the switching nail 63. Thereafter, the processed sheet S is switched back and is discharged from the second discharger 61 to the sheet stacker 60.

Therefore, regardless of whether or not the post-processing unit 40 is mounted on the image forming apparatus 200, the image forming apparatus 200 merely controls the switching of the switching nail 63, thereby facilitating control of image formation.

According to the example embodiment, since the image forming apparatus 200 reverses the processed sheet S and discharges the sheet S to the sheet stacker 60 provided on the front of the image forming apparatus 200, the sheet S can be easily retrieved therefrom even though the post-processing unit 40 is mounted on the image forming apparatus 200. In addition, the image forming apparatus 200 does not increase in height.

Figure 7:
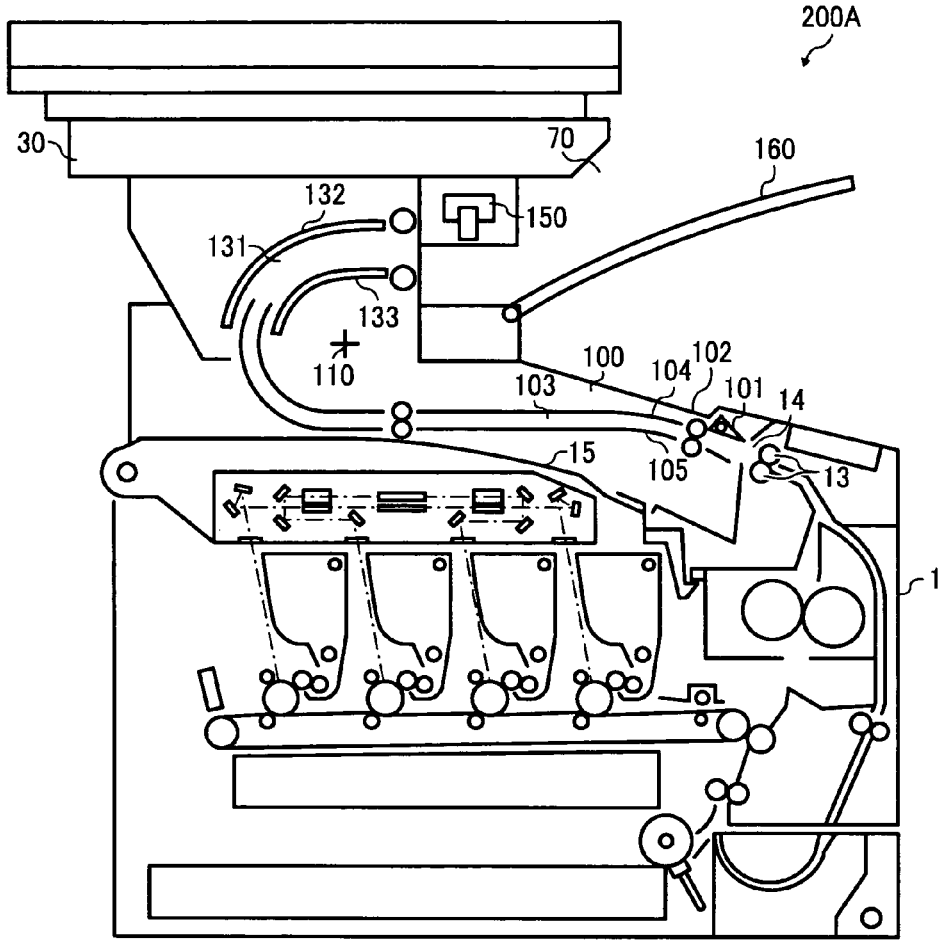
FIG. 7 is a schematic view of an image forming apparatus according to another example embodiment.
Figure 8:
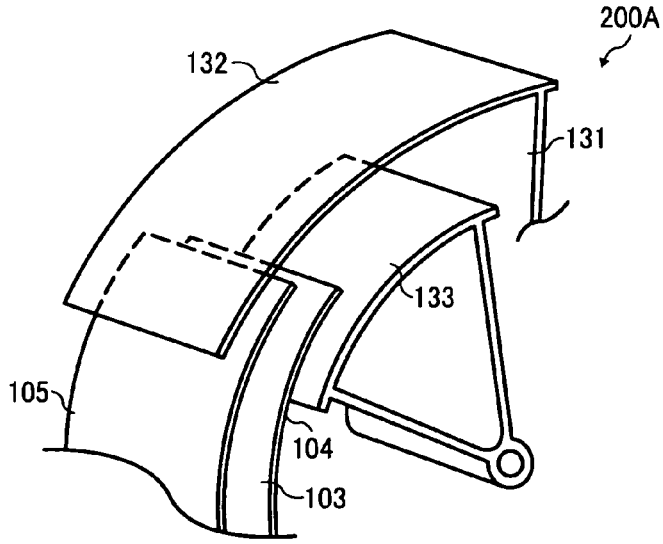
FIG. 8 is a partial perspective view (according to an example embodiment) of the image forming apparatus shown in FIG. 7.
Figure 9:
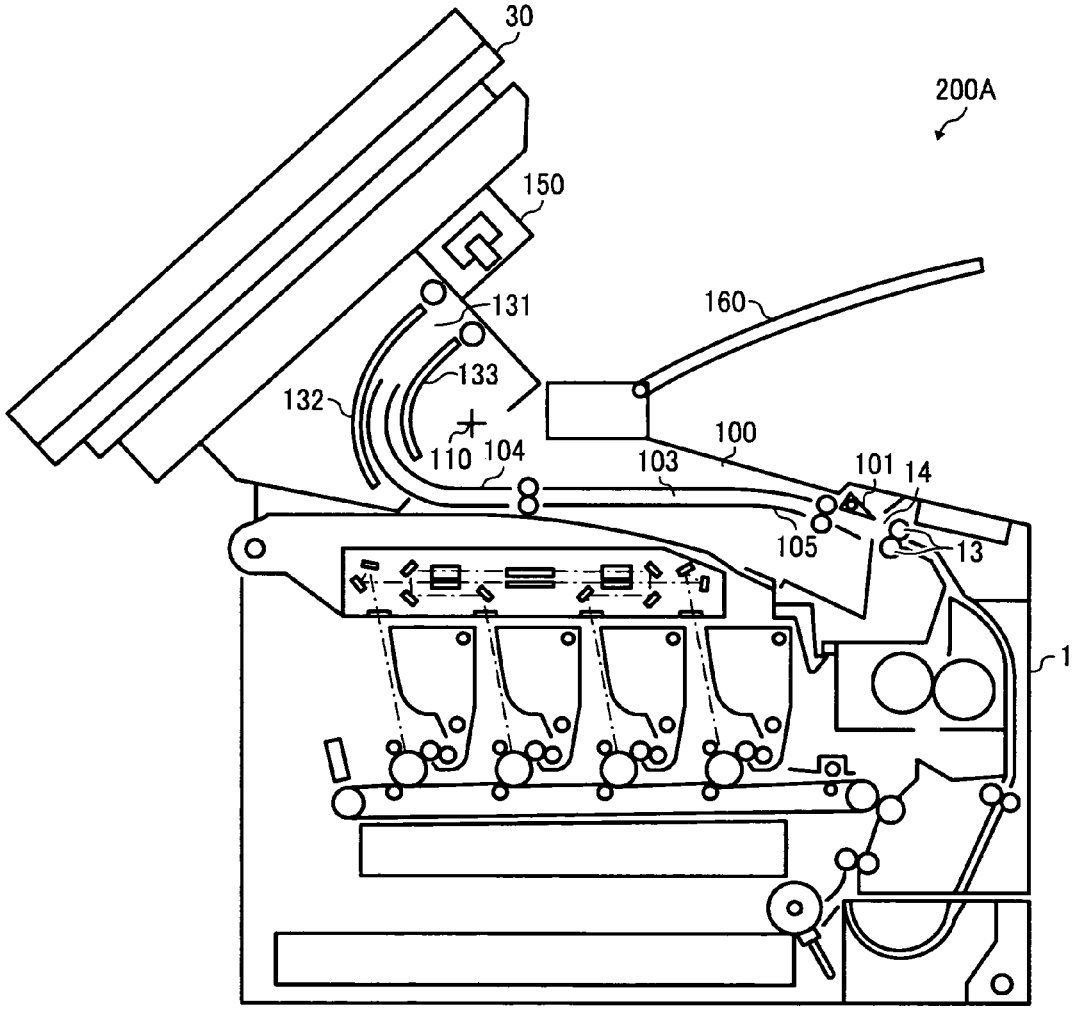
FIG. 9 is a schematic view (according to an example embodiment) of the image forming apparatus shown in FIG. 7 with a scanner included in the image forming apparatus rotated upwards.

Referring to FIGS. 7, 8, and 9, a description is now given of an image forming apparatus 200A according to another example embodiment. FIG. 7 is a schematic view of the image forming apparatus 200A. The image forming apparatus 200A includes a support conveyer 100, an axis of rotation 110, a discharge path 131, upper and lower guide plates 132 and 133, a second sheet stacker 160, and/or a post-processing device 150. The support conveyer 100 includes a separation nail 101, a first sheet stacker 102, a conveyance path 103, and/or upper and lower guide plates 104 and 105. The other elements of the image forming apparatus 200A are equivalent to those of the image forming apparatus 200 depicted in FIG. 1.

The support conveyer 100 for supporting the scanner 30 is provided above the sheet stacker 15 and detachably attached to the body 1 with a fixing member, for example, a screw, and the like, not shown. The separation nail 101, serving as a switching member, is provided downstream from the exit 14, serving as a first sheet discharger, in a sheet conveyance direction, and switches to cause the sheet S to be discharged to the first sheet stacker 102 provided on the support conveyer 100 or to be conveyed to the conveyance path 103, serving as a non-reverse path, provided inside the support conveyer 100. The conveyance path 103 is formed by the upper guide plates 104 and 105. It is to be noted that an operator can remove the sheet S stacked on the first sheet stacker 102 in front of the image forming apparatus 200A.

The scanner 30 is rotatably supported by the support conveyer 100 around the axis of rotation 110. The discharge path 131, serving as a reverse path, is provided below the scanner 30 and connected to the conveyance path 103. The discharge path 131 is formed by the upper guide plates 132 and 133. Outside an exit of the discharge path 131 are provided the post-processing device 150, for example, a rotary punch and the like, and the second sheet stacker 160 for stacking a processed sheet S. The operator can remove the sheet S stacked on the second sheet stacker 160 from the opening 70 provided on the front of the image forming apparatus 200A.

FIG. 8 is a partial perspective view of the upper guide plates 104 and 105, and the upper and lower guide plates 132 and 133. The conveyance path 103 and the discharge path 131 are connected to each other and have concentric round shapes. In other words, connection portions of the upper and lower guide plates 104 and 105, and the upper and lower guide plates 132 and 133 have concentric arc shapes. It is to be noted that a center of the arc shape corresponds to the axis of rotation 110 of the scanner 30. A gap between the upper and lower guide plates 132 and 133 of the discharge path 131 is greater than a gap between the upper and lower guide plates 104 and 105 of the conveyance path 103.

FIG. 9 is a schematic view of the image forming apparatus 200A when the scanner 30 rotates upwards. Since the axis of rotation 110 of the scanner 30 corresponds to the center of the concentric round shape of the connection portion between the conveyance path 103 and the discharge path 131, even when the scanner 30 rotates upwards the conveyance path 103 remains connected to the discharge path 131. Therefore, even when the operator moves the scanner 30 upwards in order to remove the sheet S discharged to the first sheet stacker 102, another sheet S to be post-processed can be conveyed to the post-processing device 150. Additionally, when the operator rotates the scanner 30 upwards in order to deal with a paper jam between the conveyance path 103 and the discharge path 131, since the upper and lower guide plates 104 and 105 of the conveyance path 103 are inserted into the discharge path 131 sandwiched between the upper and lower guide plates 132 and 133, neither the conveyance path 103 nor the discharge path 131 bends. Therefore, the jammed sheet S hardly bends, and thus can be reused for printing.

Figure 10:
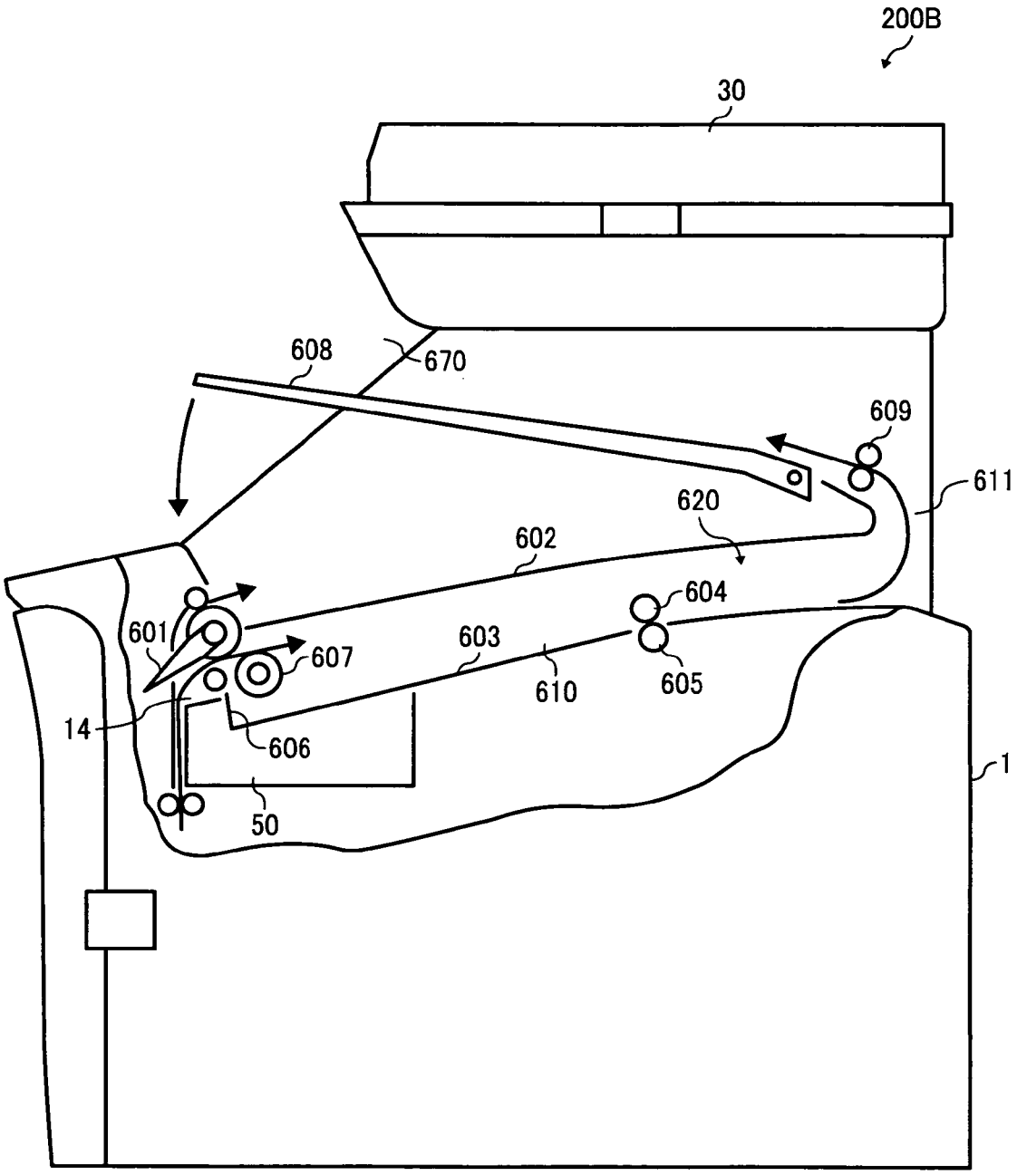
FIG. 10 is a schematic view of an image forming apparatus according to yet another example embodiment of the present invention.

Referring to FIG. 10, a description is now given of an image forming apparatus 200B according to yet another example embodiment. FIG. 10 is a schematic view of the image forming apparatus 200B. The image forming apparatus 200B includes a switching guide nail 601, a first sheet stacker 602, a stacking table 603, conveyance rollers 604 and 605, a stopper 606, a support roller 607, a second sheet stacker 608, a discharge roller 609, a conveyance path 620, and/or an opening 670. The conveyance path 620 includes a non-reverse path 610 and a reverse path 611. The other elements of the image forming apparatus 200B are equivalent to those of the image forming apparatus 200 depicted in FIG. 1.

The switching guide nail 601, serving as a switching member, is provided at the exit 14, serving as a first sheet discharger, of the image forming apparatus 200B, and selectively conveys a sheet S discharged from the image recorder 2 to the first sheet stacker 602 or to the post-processing device 50. When the sheet S conveyed to the post-processing device 50 moves to the stacking table 603 through the non-reverse path 610, the conveyance roller 604 moves upwards to separate from the conveyance roller 605, so as to pass a leading edge of the sheet S between the conveyance rollers 604 and 605. When the sheet S is stacked on the stacking table 603 after a predetermined time period passes since a sensor, not shown, detects that a trailing edge of the sheet S passes through the discharge roller pair 13, the conveyance roller 604 moves downwards to slightly press the conveyance roller 605 via the sheet S. Thereafter, when the conveyance rollers 604 and 605 rotate in reverse directions, the sheet S hits the stopper 606 as a wall surface, thereby the leading edge thereof is aligned. It is to be noted that the support roller 607 includes a flexible foam, for example, a sponge and the like, and prevents the sheet S from rolling up. After being aligned on the stacking table 603, a single or plurality of sheets S is subjected to post-processing performed by the post-processing device, for example, a stapler, a punch, and/or the like. When the conveyance rollers 604 and 605 rotate in normal directions to convey the sheet S toward the discharge roller 609 through the non-reverse path 610, the sheet S is reversed while passing through the reverse path 611 and stacked on the second sheet stacker 608 via the discharge roller 609, serving as a second sheet discharger. A non processed sheet S is stacked on the first sheet stacker 602. Therefore, an operator can remove the sheet S stacked on the second sheet stacker 608 from the opening 670 provided on a front of the image forming apparatus 200B. Also, the operator can remove the sheet S stacked on the first sheet stacker 602 in front of the image forming apparatus 200B.

The present invention has been described above with reference to specific example embodiments. Nonetheless, the present invention is not limited to the details of example embodiments described above, and various modifications and improvements are possible without departing from the spirit and scope of the present invention. The number, position, shape, and the like, of the above-described constituent elements are not limited to the above-described example embodiments, but may be modified to the number, position, shape, and the like, which are appropriate for carrying out the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus, comprising:

an image recorder to form an image on a sheet;

a first sheet discharger to discharge the sheet bearing the image in a first direction from a proximal end to a distal end of the image forming apparatus;

an image reader provided above the image recorder to form a gap therebetween;

a post-processing device to perform post-processing including at least one of stapling, punching, stamping, and sorting of the sheet discharged from the first sheet discharger;

a second sheet discharger provided between the first sheet discharger and the image reader, and to discharge the sheet post-processed by the post-processing device in a second direction opposite to the first direction in which the first sheet discharger discharges the sheet bearing the image;

a sheet stacker to stack the sheet discharged from the second sheet discharger;

an opening provided between the sheet stacker and the image reader to enable the sheet discharged from the second sheet discharger to be retrieved from the sheet stacker in the second direction in which the sheet is discharged from the second sheet discharger, the post-processing device-being disposed within the sheet conveyance path; and a transit conveyer provided below the sheet stacker, and to guide the sheet from the first sheet discharger to the second sheet discharger;

wherein the sheet stacker opens to enable the transit conveyer to be accessible from the opening.

2. An image forming apparatus, comprising:

an image recorder to form an image on a sheet;

a first sheet discharger to discharge the sheet bearing the image in a first direction from a proximal end to a distal end of the image forming apparatus;

an image reader provided above the image recorder to form a gap therebetween;

a post-processing device to perform post-processing including at least one of stapling, punching, stamping, and sorting of the sheet discharged from the first sheet discharger;

a second sheet discharger provided between the first sheet discharger and the image reader, and to discharge the sheet post-processed by the post-processing device in a second direction opposite to the first direction in which the first sheet discharger discharges the sheet bearing the image;

a sheet stacker to stack the sheet discharged from the second sheet discharger;

a sheet conveyance path provided between the first sheet discharger and the second sheet discharger;

an opening provided between the sheet stacker and the image reader to enable the sheet discharged from the second sheet discharger to be retrieved from the sheet stacker in the second direction in which the sheet is discharged from the second sheet discharger, the post-processing device-being disposed within the sheet conveyance path;

wherein the image reader and a part of the sheet conveyance path are integrated into a single unit rotatable with respect to the image recorder, and wherein the sheet conveyance path includes a round portion to guide the sheet from the first sheet discharger to the second sheet discharger, the round portion having a center identical to a center of rotation of the image reader.

* * * * *